United States Patent [19]

Jadwin et al.

[11] 4,394,430

[45] Jul. 19, 1983

[54] ELECTROPHOTOGRAPHIC DRY TONER AND DEVELOPER COMPOSITIONS

[75] Inventors: Thomas A. Jadwin, Rochester; Robert C. Storey, Penfield, both of N.Y.

[73] Assignee: Eastman Kodak Company, Rochester, N.Y.

[21] Appl. No.: 254,028

[22] Filed: Apr. 14, 1981

[51] Int. Cl.[3] ..... G03G 9/10

[52] U.S. Cl. ..... 430/110; 430/108; 430/904

[58] Field of Search ..... 430/110, 108, 904; 428/402

[56] References Cited

U.S. PATENT DOCUMENTS

| | | | |
|---|---|---|---|
| 3,417,019 | 12/1968 | Beyer | 252/62.1 |
| 3,893,935 | 7/1975 | Jadwin et al. | 252/62.1 |
| 3,944,493 | 3/1976 | Jadwin et al. | 252/62.1 P |
| 3,985,663 | 10/1976 | Lu et al. | 252/62.1 L |
| 4,139,483 | 2/1979 | Williams et al. | 430/110 |
| 4,221,856 | 9/1980 | Lu | 430/110 |

FOREIGN PATENT DOCUMENTS

| | | |
|---|---|---|
| 1117224 | 6/1968 | United Kingdom . |
| 1215521 | 12/1970 | United Kingdom . |
| 1501065 | 2/1978 | United Kingdom . |
| 1536514 | 12/1978 | United Kingdom . |

OTHER PUBLICATIONS

Technical Data Sheet of Hexcel Fine Organics re: "Stedbac" Stearyl Dimethyl Benzyl Ammonium Chloride–dated 1/75.

Data Sheet of Onyx Chemical Company re: "Ammonyx 4002", Stearyl Dimethyl Benzyl Ammonium Chloride--date unknown but prior to Apr. 14, 1980.

*Primary Examiner*—John E. Kittle
*Assistant Examiner*—John L. Goodrow
*Attorney, Agent, or Firm*—William T. French

[57] ABSTRACT

Alkyldimethylbenzylammonium salts are employed as charge control agents for fusible dry electrophotographic toners.

7 Claims, 2 Drawing Figures

ELECTROPHOTOGRAPHIC DRY TONER AND DEVELOPER COMPOSITIONS

BACKGROUND OF THE INVENTION

This invention relates to electrophotography and, more especially, to dry particulate electrostatic toners and developers.

Electrophotographic imaging processes have been described extensively in patents and other literature. These processes have in common the forming of an electrostatic charge pattern on an insulating photoconductor. The pattern, or latent electrostatic image, is made visible by contact with a developer containing electrostatically charged toner powder. Several methods of dry development are available, including the well-known magnetic brush and cascade development methods.

Most dry developers are a mixture of toner particles and carrier particles. For magnetic brush development the latter can be a magnetic substance such as iron filings, powdered iron or iron oxide. For cascade development and other methods the carrier particles can be non-magnetic substances such as glass or ceramic beads. The toner particles become triboelectrically charged by frictional contact with the carrier particles. Then, when contacted with the oppositely charged image pattern on the photoconductor, they adhere to the charged areas and make the image visible. In well-known office copying machines the developed toner image is transferred from the photoconductor to a sheet of plain paper to which it is fixed by fusion or other known techniques.

While the polymer is the major component of the toner, certain addenda usually are dispersed in the polymer. These can include one or more colorants such as pigments and dyestuffs which make the developed charge pattern visible. Also desirable as addenda are ionic compounds which help to maintain a uniform, stable, high net electrical charge on the triboelectrically charged toner particles. These compounds are known as charge control agents.

A variety of charge control agents for dry toner particles have been proposed. For example, Olson U.S. Pat. No. 3,647,695 describes an electrostatic toner containing a mono- or di-functional organic acid nigrosine salt which aids in providing a relatively high uniform net electrical charge on the toner particles. It has been found, however, that the nigrosine salts decrease the adhesion of the toner particles to a paper receiving sheet.

Greig U.S. Pat. No. 3,079,272 describes the use of 4 to 5 percent by weight of anionic compounds, such as stearic acid, in "melt-form" developer compositions containing particulate toner particles to "improve the triboelectric charge relationship" between the toner particles. However, it has been found that when fatty acids, such as stearic acid, are in the toner formulation it is difficult to impart a high net positive electrical charge to the toner particles with the magnetic carrier particles. Stearic acid also decreases the adhesion of the toner particles to paper.

Other useful charge control agents are the non-surfactant, short-chain, quaternary ammonium salts described in Jadwin et al U.S. Pat. No. 3,893,935 and the alkoxylated amines described in Jadwin et al U.S. Pat. No. 3,944,943. These quaternary ammonium salts and alkoxylated amines provide high, uniform net electrical charge to a toner powder without reducing the adhesion of the toner to paper. They are not, however, as effective as would be desired over a wide range of relative humidity.

More recently, British Pat. No. 1,501,065 has described as charge control agents certain quaternary ammonium salt surfactants which contain at least one amido group of ten or more carbon atoms. Over a wide range of relative humidity, these salts maintain a high stable charge in dry toner compositions. One drawback of such salts, however, is that the quality of the charge control that they provide may vary depending on the nature of the polymer or other components of the toner. Consequently, if the toner manufacturer wishes to alter the composition of the toner for any reason after formulating a balanced composition of toner resin, colorant and charge control agent, it may be necessary to change to another charge control agent in order to maintain the same quality of charge control. A need exists, therefore, for a charge control agent that is versatile, so that if changes are made in the toner formulation it will not be necessary to seek another charge control agent to maintain the quality of charge control that was obtainable with the original formulation.

SUMMARY OF THE INVENTION

The present invention provides improved dry electrostatic toner and developer compositions which employ as a charge control agent a type of quaternary ammonium salt surfactant which previously has been used in hair and skin lotions but which unexpectedly is an outstanding charge control agent for dry toners. This surfactant unexpectedly solves problems created by known charge control agents and forms novel toner and developer compositions which have important advantages over the prior art.

The improved toner composition of the invention comprises finely divided particles of a fusible binder polymer and, dispersed in the binder polymer as a charge control agent, a minor amount of a quaternary ammonium salt of the formula

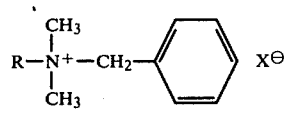

I wherein R is an alkyl group of from 12 to 24 carbon atoms and $X^-$ is an anion. Advantageously, a colorant such as a pigment or dye is also dispersed in the binder polymer of the toner.

The developer composition of the invention comprises toner particles, as described, and carrier particles. Preferred are ferromagnetic carrier particles which are coated with a fluorocarbon polymer. In an especially preferred embodiment, the fusible binder polymer of the toner is an emulsion-polymerized styrene-butylacrylate copolymer.

DESCRIPTION OF THE PREFERRED EMBODIMENTS

Figure 1:
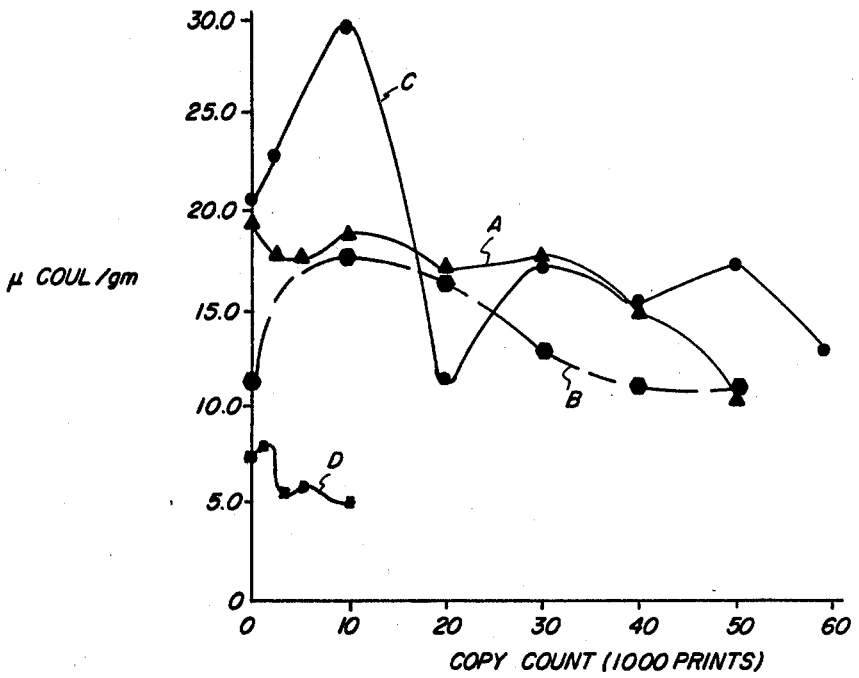
FIG. 1 is a graph which compares two developers of the invention with two other developers with respect to retaining a high ratio of toner charge to mass over a long period of use.

The compositions of the present invention provide numerous advantages. As a consequence of incorporating the described quaternary ammonium salt in the toner polymer, the dry particulate toner composition exhibits a relatively high, uniform and stable net toner charge when mixed with carrier particles even over wide ranges of relative humidity. The amount of toner throw-off is also quite low even at low and high relative humidities (RH), e.g., at 5 percent RH and 28° C. and at 90 percent RH and 28° C. In contrast to certain prior art charge control agents, these compounds do not decrease the adhesion of the fused toner to paper. Furthermore, the fact that this type of compound is so mild that it has been used in skin lotions and therefore presents substantially no risk of skin irritation, provides another advantage. It has also been found that the toner compositions of the invention form good to excellent images with uniform density and little or no background scumming.

A major benefit of the invention is that the charge control agents used in the novel toners are unexpectedly versatile in their utility. They are more adaptable to variations in the toner components than other charge control agents. This enables them to form toners having better properties, especially over long periods of developer use, with a wide variety of binder polymers, than prior art charge control agents which otherwise have similar good properties.

One of the benefits flowing from the unexpected versatility of the described charge control agents is that they form superior toner compositions with a styrene-acrylic binder polymer which is made by continuous emulsion polymerization. For reasons that are not clear, but which may be that such polymers contain ionic impurities that affect their electrical properties, prior art charge control agents that are also quaternary ammonium salts and that perform very well with many binder polymers, including styrene-acrylic copolymers made by batch suspension polymerization, are not outstanding as charge control agents for styrene-acrylic copolymers made by continuous emulsion polymerization.

Consequently, a preferred toner composition of the invention comprises a major amount of a styrene-acrylic binder polymer, and most preferably a styrene-butylacrylate copolymer, which has been made by continuous emulsion polymerization and a minor amount of a quaternary ammonium salt I.

An especially preferred developer composition of the invention comprises the described toner in particulate form and ferromagnetic carrier particles partially coated with a fluorocarbon polymer. This developer composition is notable for its retention of relatively stable conductivity and a relatively stable and high ratio of toner charge to mass over long periods of use in magnetic brush development.

The fusible binder polymers that can be used in the compositions of the invention include the various polymers that conventionally have been employed in dry electrostatic toners. These have a glass transition temperature within the range from 40° to 120° C. Preferably, the toner particles have relatively high caking temperature, for example, higher than about 55° C., so that they may be stored without agglomerating. The softening temperature is within the range from 40° C. to 200° C., and preferably from 40° C. to 65° C., so that the toner particles can readily be fused to paper receiving sheets. If other types of receiving elements are used, for example, metal printing plates, polymers having a higher softening temperature and glass transition temperature can be used.

The fusible binder polymers which can be employed in the toner compositions of the invention include homopolymers and copolymers of styrene, polycarbonates, resin-modified maleic alkyd resins, polyamides, phenol-formaldehyde resins and derivatives thereof, polyesters, modified alkyd resins, aromatic resins containing alternating methylene and aromatic units such as described in Merrill et al, U.S. Pat. No. 3,809,554, and fusible cross-linked polymers as described in Jadwin et al, U.S. Pat. No. 3,938,992.

Especially useful are styrene-acrylic copolymers of from 40 to 100 percent by weight of styrene or styrene homologs; from 0 to 45 percent by weight of one or more lower alkyl acrylates or methacrylates having from 1 to 4 carbon atoms in the alkyl group; and from 0 to 50 percent by weight of one or more other vinyl monomers, for example, a higher alkyl acrylate or methacrylate (including branched alkyl) and cycloalkyl acrylates and methacrylates) having from 6 to 20 or more carbon atoms in the alkyl group. A preferred styrene-containing copolymer of this kind is prepared from a monomeric blend of 40 to 60 percent by weight styrene or styrene homolog, from 20 to 50 percent by weight of a lower alkyl acrylate or methacrylate and from 5 to 30 percent by weight of a higher alkyl acrylate or methacrylate such as ethylhexyl acrylate. The preferred fusible styrene copolymers are those which are covalently cross-linked with a small amount of a divinyl compound such as divinylbenzene. As is explained in more detail elsewhere in this specification, the charge control agent is especially suited for use with a binder polymer which is a copolymer of styrene and butylacrylate, made by emulsion polymerization and cross-linked with 0.05 to 3 weight percent of divinylbenzene.

The amount of binder polymer employed in the toner particles can vary but is usually greater than 50 percent by weight of the toner composition. Preferred are amounts of binder polymer within the range from 75 to 98 weight percent based on the total weight of the toner composition.

A convenient method for preparing the toner is melt blending. This involves melting the binder polymer and mixing it with dyes or pigments and the charge control agent on heated compounding rolls. After thorough blending, the mixture is cooled and solidified. The solid mass is broken into small particles and finely ground to form a free-flowing powder of toner particles.

Particles of mean diameter between 0.1 micron and 100 microns may be used; although, present day office copying machines employ particles of mean diameter between 1 to 30 microns. Larger or smaller particles can be used for particular methods of development. For example, in powder cloud development such as described in U.S. Pat. No. 2,691,345, extremely small toner particles can be used.

The charge control agents are added to the toner in an amount effective to improve the charge properties of the toner composition. These charge control agents improve the charge uniformity of a toner composition, that is, they insure that substantially all of the individual toner particles exhibit a triboelectric charge of the same sign (negative or positive) with respect to a given carrier; they increase the net electrical charge of the toner particles relative to a given carrier vehicle; and they reduce the amount of "toner throw-off." As used herein, the phrases "net electrical charge of the toner particles" and "net toner charge" are equivalent and are defined as the total electrical charge on a given amount of a toner when admixed with a given amount of carrier. Although the phenomenon by which such an electrical charge is imparted is not fully understood, it is believed due in large part to the triboelectric effect of the physical admixture of toner and carrier. The term "toner throw-off" is defined as the amount of toner powder thrown out of a developer mix as it is mechanically agitated, e.g., in a development apparatus. Aside from the extraneous contamination problems inherent with airborne toner dust, "toner throw-off" also leads to imaging problems such as unwanted background development and scumming of the photoconductor.

In the toner compositions of the present invention it has been found desirable to employ an amount of charge control agent within the range of 0.01 to 3 weight percent and preferably 0.2 to 2 weight percent based on the total weight of the particulate toner composition. If much lower amounts are used, the charge control agent provides little or no effect. If much higher amounts are used, the net charge of the toner becomes unstable and is substantially reduded. The optimum amount will depend on the components selected for the particular toner composition.

As previously described, the compounds which have such unexpectedly valuable utility as charge control agents for dry toners are trialkylbenzyl quaternary ammonium salts of the formula

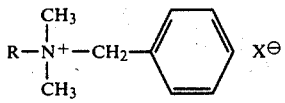

wherein R is an alkyl group, straight or branched chain, of from 12 to 24 carbon atoms and $X^-$ is an anion. Preferably R is a straight chain alkyl group of from 16 to 20 carbon atoms and most preferably is octadecyl. Since these compounds are cationic surfactants, essentially any anion is satisfactory. The preferred anions are halogen ions, alkyl sulfates and sulfonates and aryl sulfonates such as p-toluenesulfonates. Most preferably $X^-$ is a chlorine ion. These are known compounds and at least one species is available commercially, namely, the compound, benzyldimethyloctadecyl ammonium chloride. It can be obtained from Onyx Chemical Company of Jersey City, New Jersey under the trademark "Ammonyx 4002" and from Hexcel Company of Lodi, N.J. under the trademark "Stedbac."

A variety of dyestuffs and pigments can be employed as colorants in the toner compositions of the invention. Of course, toners can be prepared without the use of a colorant if it is desired to have a developed image of low optical opacity. If used, however, the colorant can be virtually any of the compounds mentioned in the *Colour Index* Volumes 1 and 2, Second Edition. Carbon black is a preferred colorant. The amount of colorant can vary over a wide range, for example, from about 1 to about 20 percent of the weight of the polymeric binder. Particularly good results are obtained when the amount is from 2 to 10 weight percent.

The toners of this invention normally are mixed with a carrier to form developing compositions. Suitable carriers include various nonmagnetic particles such as glass beads, crystals of inorganic salts such as sodium or potassium chloride, hard resin particles, metal particles, etc. In addition, magnetic carrier particles can be used. Suitable magnetic carrier materials include ferromagnetic materials such as iron, cobalt, nickel, and alloys and mixtures thereof.

In developers for use in magnetic brush development the carrier preferably comprises ferromagnetic particles overcoated with a thin or discontinuous layer of film-forming resin, for example, a fluorocarbon polymer such as polytetrafluoroethylene, polyvinylidene fluoride or a copolymer of vinylidene fluoride and tetrafluoroethylene or an alkali-soluble carboxylated polymer as described in Miller U.S. Pat. No. 3,547,822. Other useful resin-coated magnetic carrier particles are described in Miller, U.S. Pat. No. 3,632,512; McCabe, U.S. Pat. No. 3,795,617; and Kasper U.S. Pat. No. 3,795,618. Preferably the carrier comprises an iron core which has been subjected to high temperature oxidation treatment in a fluidized bed as described in U.S. Pat. No. 3,767,477 to form a high resistance, durable, iron oxide layer thereon, followed by treatment of the resulting iron oxide coated core in the bed with an inert atmosphere at elevated temperatures while a coating of a fluoropolymer layer is applied thereover. The resultant carrier may be preconditioned as described in Olson et al U.S. Pat. No. 3,970,571 at least a portion of the toner removed and fresh toner added thereto before use.

A typical developer composition containing the described toner and carrier particles comprises from about 1 to about 10 percent by weight of toner particles. The carrier particles can have a particle size of from about 30 to about 1200 microns, preferably 60–300 microns, and thus usually are larger than the toner particles. Developer compositions of the invention can also, however, employ smaller carrier particles, including those which are of about the same size as the toner particles, e.g., of 1 to 30 microns average diameter.

The following examples provide a further understanding of the invention.

EXAMPLE 1

Preparation of Toner and Developer

A fusible, cross-linked copolymer was formed by continuous emulsion polymerization of styrene and butylacrylate in a 3:1 weight ratio using 0.6–0.7 weight percent divinylbenzene (55 weight percent assay) as the cross-linking agent and ammonium persulfate, sodium metabisulfite as the polymerization initiator. The covalently cross-linked styrene-butylacrylate copolymer, in an amount of 100 parts by weight was compounded on a heated two-roll mill with 6 parts by weight of powdered carbon black (Regal 300 obtained from Cabot Corporation) and with 1.5 parts by weight of the charge control agent, octadecyldimethylbenzyl ammonium chloride ("Ammonyx 4002"). After compounding, the toner composition was ground in a fluid energy mill to a fine powder having an average particle size of about 8 microns. This toner is designated as "Toner A." A developer was then formed by mixing approximately 3.5 parts by weight of the powdered toner with approximately 96.5 parts of resin-coated ferromagnetic carrier particles. The latter consisted of iron particles (Hoeganaes EH sponge iron) of about 125 microns average particle size, partially coated with a vinylidene fluoride (Kynar resin obtained from Pennwalt Chemical Company).

Table 1 below gives the compositions of three additional toners prepared substantially as in Example 1 above but using either a different polymer or a different charge agent. The polymer in Toners C and D was a cross-linked styrene-butylacrylate copolymer which was prepared by batch suspension polymerization instead of by continuous emulsion polymerization. The charge agent in Toners B and D was the quaternary ammonium salt, 3-lauramidopropyl trimethylammonium methylsulfate, which is a prior art charge agent disclosed in British Pat. No. 1,501,065.

The four toners identified in Table 1 were incorporated in developers, using the same kind and proportions of carrier particles as described in Example 1. The amount of charge agent in each toner was optimized for the particular composition. The developers were then tested in the magnetic brush development of electrophotographic images in a plain paper copying machine. These were long copying runs extending for as many as 275,000 copies. During the tests of each developer, measurements were made periodically of the charge to mass ratio of the toner using an iron Faraday tube and a Keithley electrometer, substantially in the manner described in U.S. Pat. No. 3,795,617. The data obtained are plotted in FIG. 1 of the drawings.

TABLE 1

| Toner | Polymer Type | Charge Control Agent | Amount of Charge Control Agent added (PPH) | Measured Bulk Charge Agent (%) | Measured Surface Charge Agent (%) | PSD (microns) G.M. | PSD (microns) S.D. |
|---|---|---|---|---|---|---|---|
| A | CE | a | 1.5 | 1.30 | 0.020 | 7.89 | 2.00 |
| D | CE | b | 1.0 | 0.60 | 0.035 | 7.95 | 2.01 |
| C | BS | a | 1.5 | 1.25 | 0.224 | 7.88 | 1.94 |
| B | BS | b | 1.0 | 0.94 | 0.134 | 7.86 | 1.95 |

Legend:
CE = crosslinked styrene-butylacrylate copolymer made by continuous emulsion polymerization
BS = crosslinked styrene-butylacrylate copolymer made by batch suspension polymerization
a = benzyldimethyloctadecyl ammonium chloride
b = 3-lauramidopropyltrimethylammonium methylsulfate
PSD = particle size distribution
GM = geometric mean
SD = standard deviation FIG. 1 shows that Toner A, a preferred composition of the invention comprising a quaternary ammonium salt according to formula I and the cross-linked styrene-butylacrylate copolymer made by continuous emulsion polymerization maintained a stable, high ratio of charge to mass during a copying run extending to 50,000 prints. Toner B containing a batch, suspension polymerized polymer and a prior art charge control agent was satisfactory although its charge to mass ratio decreased sooner than that of Toner A. Toner C, which is also a composition of the invention, contained the batch, suspension-polymerized polymer (with the same charge control agent as Toner A). It fluctuated in its charge level up to about 30,000 prints but the charge remained high and stable thereafter. Toner D, containing the continuous emulsion-polymerized polymer and the prior art charge agent, did not develop a satisfactory high charge and the test terminated at 10,000 prints.

Figure 2:
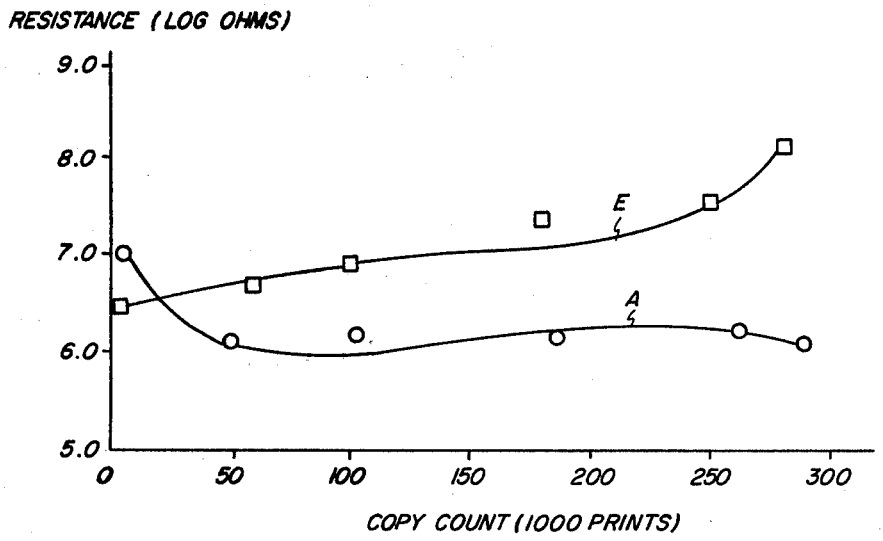
FIG. 2 compares a developer of the invention with another developer with respect to maintaining stable electrical resistance over a long period of use.

FIG. 2 of the drawing compares a developer of the invention, developer A of Table 1, with a developer E. Developer A contained toner A of Table 1. The binder polymer for Toner E of developer E was a terpolymer of styrene, 2-ethylhexylmethacrylate and methyl methacrylate cross-linked with divinylbenzene substantially as disclosed in Example 1 of U.S. Pat. 3,938,992. The charge agent was 3-lauramidopropylammonium methyl sulfate. The ratios of carbon black, charge agent and binder polymer were approximately the same in Toners A and E. The developers used the same type of ferromagnetic carrier particles and the same concentrations of toner.

Developers A and E were tested in magnetic brush development in long copying runs extending to about 275,000 copies. Periodically during the tests measurements were made of the electrical resistance of the developer. FIG. 2 shows that after about 50,000 copies, Developer A maintained a substantially constant resistance while Developer E steadily increased in resistance throughout the test.

Although the invention has been described in considerable detail with particular reference to certain preferred embodiments thereof, variations and modifications can be effected within the spirit and scope of the invention.

We claim:

1. A two-component electrophotographic developer comprising magnetic carrier particles and a dry particulate electrophotographic toner comprising a major amount of binder polymer and dispersed therein as a charge control agent in an amount of 0.01 to 3 weight percent of the particulate toner, a quaternary ammonium salt of the formula:

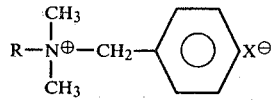

wherein R is alkyl of 12 to 24 carbon atoms and $X^{\ominus}$ is an anion.

2. A developer according to claim 1 wherein the binder polymer also has a colorant dispersed therein and R is straight chain alkyl of 16 to 20 carbon atoms and $X^-$ is a halogen ion, an alkyl sulfate ion, an alkyl sulfonate ion or an aryl sulfonate ion.

3. A developer according to claim 2 wherein R is octadecyl and $X^-$ is a chlorine ion.

4. A developer according to claim 2 wherein the binder polymer is a styrene-acrylic copolymer.

5. A developer according to claim 4 wherein the binder polymer is an emulsion polymerized, covalently cross-linked, styrene-butylacrylate copolymer and the colorant is carbon black.

6. A developer according to claim 5 wherein the toner contains 0.05 to 2 parts by weight of said quaternary ammonium salt and from 2 to 8 parts by weight of carbon black per hundred parts of polymer.

7. An electrophotographic developer according to claim 6 comprising a mixture of ferromagnetic carrier particles partially coated with a fluorocarbon polymer and said particulate toner.

* * * * *